US005475951A

United States Patent [19]

Litzow

[11] Patent Number: 5,475,951

[45] Date of Patent: Dec. 19, 1995

[54] SKID RESISTANT SURFACE AND ITS PREPARATION

[75] Inventor: Mervyn R. Litzow, Chagrin Falls, Ohio

[73] Assignee: Safeguard Technology, Inc., Chagrin Falls, Ohio

[21] Appl. No.: 176,650

[22] Filed: Jan. 3, 1994

[51] Int. Cl.[6] ..... E04F 11/16

[52] U.S. Cl. ..... 52/177; 52/181

[58] Field of Search ..... 52/177, 179, 181; 428/143, 148, 99, 237, 242, 908.8

[56] References Cited

U.S. PATENT DOCUMENTS 3,575,780 4/1971 Trieschmann et al. .
3,676,198 7/1972 McGroarty .
3,745,034 7/1973 Smith et al. .
4,029,852 6/1977 Palena .
4,243,696 1/1981 Toth .
4,528,231 7/1985 Lund ..... 52/177 X
4,998,391 3/1991 Connew .
5,077,137 12/1991 Molnar .
5,256,170 10/1993 Harmer et al. .

*Primary Examiner*—Creighton Smith
*Attorney, Agent, or Firm*—Vickers, Daniels & Young

[57] ABSTRACT

A shaped or flat article is described, having a skid resistant surface useful on floors, stairs, ladder rungs, ramps and other locations where a highly durable surface is required. The article is prepared by etching and cleaning a surface of the metallic base followed by adhering and fully covering the base, in the area where the skid resistant surface is required, with a flexible mesh layer embedded in a thermosetting resin such as a flexible epoxy resin. Partially embedded in the resin over the mesh are particles of a grit material. One or more additional layers of a suitable coating such as paint may be applied on top of the cured resin for visibility, luminescence, cleanability, and added protection.

18 Claims, 4 Drawing Sheets

FIG. 6
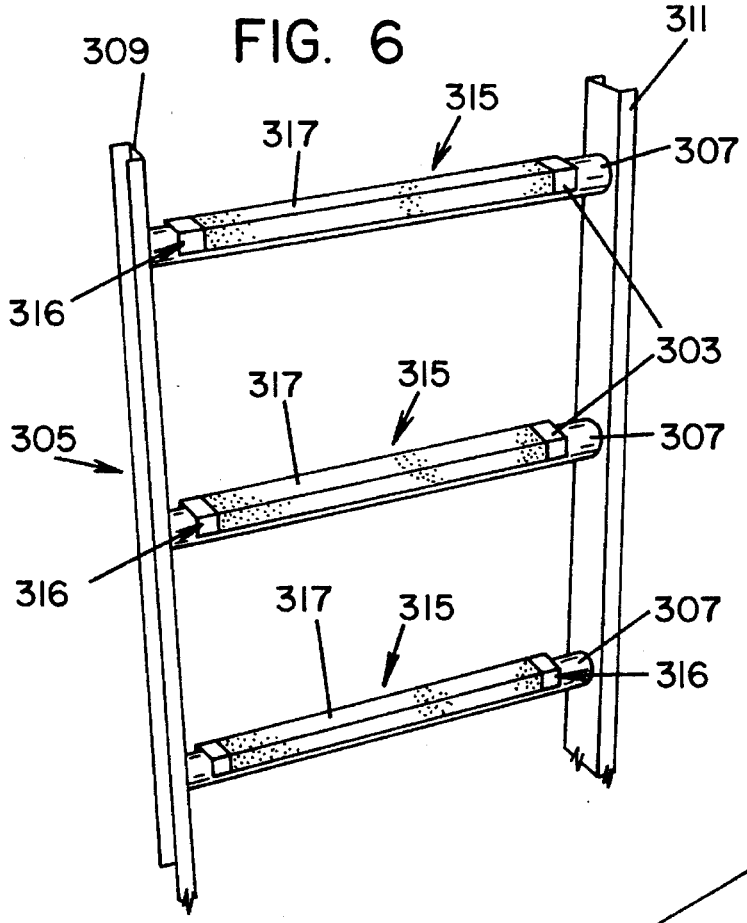
FIG. 9
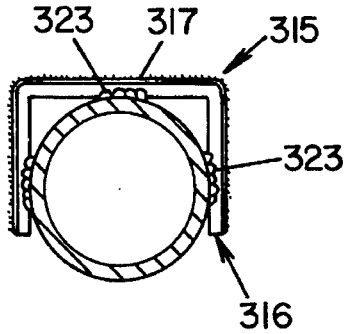
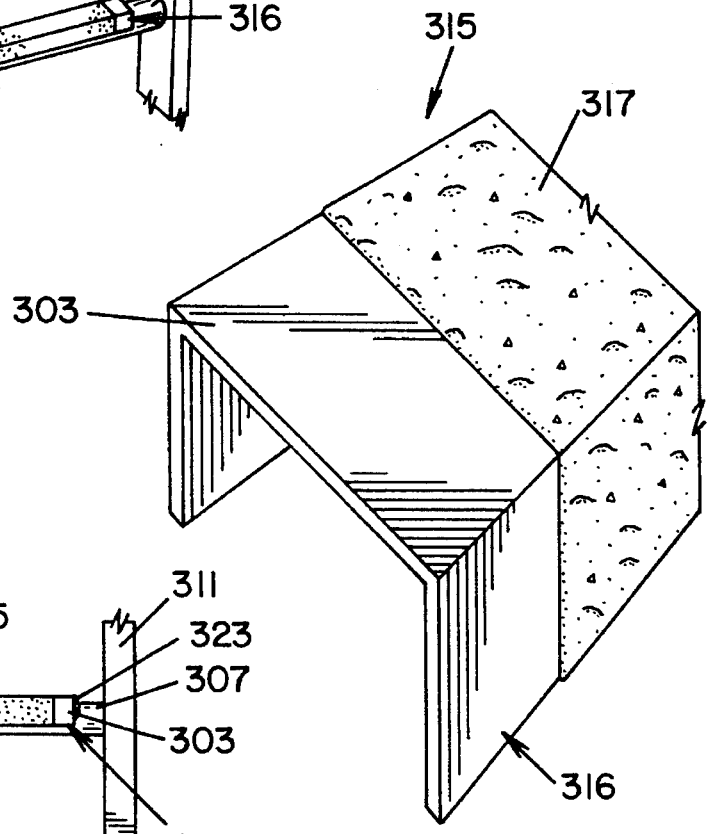
FIG. 7
FIG. 8
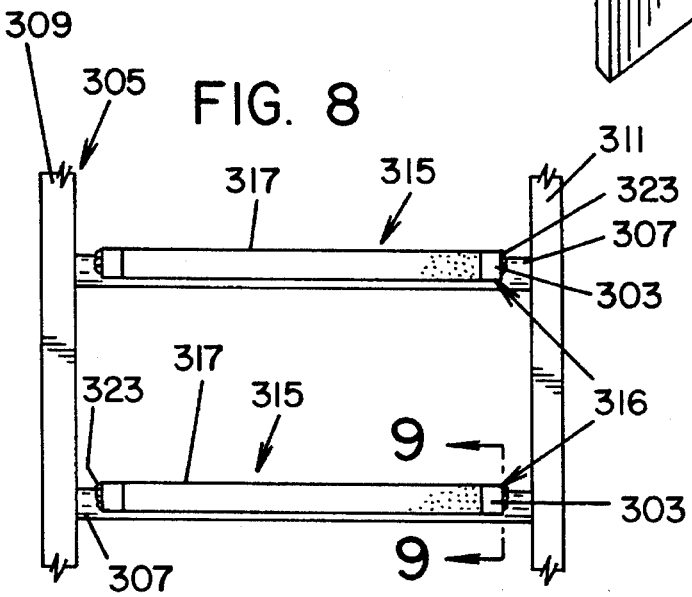

SKID RESISTANT SURFACE AND ITS PREPARATION

BACKGROUND OF THE INVENTION

1. Technical Field

This invention relates to skid resistant surfaces, particularly surfaces having exposed embedded elements such as particles of grit securely bonded to a metallic substrate and to the method of preparing such a surface.

2. Description of Related Art

This invention is directed to a new article of manufacture which can be used in a variety of applications to provide enhanced safety to persons walking, climbing, working or otherwise moving around on surfaces that may have a tendency to become slippery through repeated use, through spillage, or because the surfaces are wet. Catwalks, landings, walkways, workstations, ramps, ladders and stairs are just some of the places where the article prepared by this invention can be used. In addition it can be used in locations where operating equipment such as lifts, cranes, and tow-motors move across such surfaces that tend to become slippery during use.

A variety of methods have traditionally been used to produce surfaces with skid resistant characteristics. The production of such surfaces using electric arc or gas flame spraying are shown in a number of references such as U.S. Pat. No. 4,029,852 and U.S. Pat. No. 5,077,137. The deposition of a metallic powder on a metal strip by electrostatic techniques using a gaseous aerosol is described in U.S. Pat. No. 3,745,034. The use of ground rubber or cork, bonded by polyvinyl chloride, acrylic resins or polyisobutylene is shown and described in U.S. Pat. No. 3,575,780. U.S. Pat. No. 3,676,198 describes the application of granular bentonite to a substrate, with the bentonite admixed with a suitable adhesive. U.S. Pat. No. 4,243,696 describes a method for cascading a mixture of powdered resin and particulate material onto the surface of an article followed by heating to soften the resin and adhere the particles to the surface. U.S. Pat. No. 5,256,170 describes a coated abrasive article such as a sanding belt comprising a monolayer of grit particles adhered to a flexible backing using a make-coat layer and a size coat layer, either of which may contain epoxy resins.

Each of these processes or the resultant products have certain deficiencies. For example, the coated surface may not have adequate abrasion resistance, whereupon the surface is quickly abraded and the skid resistant characteristics are lost; the substrate and/or layers may be sufficiently thick so as to present a trip hazard when the product is mounted on stair treads, walkways, etc.; organic solvents may be required for production thus compelling special handling by personnel, and creating an environmental drawback; the surface may lack the ability to resist degradation when used in applications where it may be subjected to chemical spills, or environments where corrosive or other damaging vapors are present.

SUMMARY OF THE INVENTION

One objective of the present invention is to overcome the myriad deficiencies and drawbacks inherent in the prior art preparation of skid resistant surfaces, as well as drawbacks in the surfaces per se.

Another objective is to provide articles that have highly skid resistant surfaces, and can be readily installed on existing stairways, ladder rungs, walkways, platforms, gratings and other structures.

Yet another objective is to provide a highly skid resistant surface using methodology that does not adversely affect the environment.

Yet another objective is a highly chemically resistant and wear resistant coated article that can be produced in a variety of shapes, sizes, colors, and particle textures for differing end use applications.

These and other objects, features and advantages will become apparent from a consideration of the following detailed description, taken in conjunction with the accompanying drawings.

Briefly in one aspect of the invention, a shaped article with a skid resistant surface comprises a shaped ferrometallic base, a flexible reinforcing mesh layer covering the portion of the base wherein skid resistance is intended, said mesh coating adhered to said base by a cured thermosetting resin, and particles of a suitable ,grit embedded in said cured thermosetting resin on top of the flexible mesh layer. Preferably, the cured thermosetting resin is a polyepoxide resin, and said flexible mesh layer is comprised of cotton cloth. For industrial uses, the grit particles preferably consist of particles of silicon carbide having a size distribution such that approximately 30% to 70% of the particles are 20 grit particles and approximately 70% to 30% of the particles are between 16 and 30 grit. The skid resistant surface is preferably finished off with one or more layers of paint to enhance the visibility, luminescence, durability, cleanability or other features of the article.

In another embodiment of the invention, the skid resistant surface is prepared by a) applying a curable thermosetting resin layer onto a receptive surface of a metallic base to form a coated surface; b) embedding a reinforcing layer of flexible mesh in said resin covering said surface; c) embedding particles of said grit in said curable layer, and d) fully curing the resin layer to anchor the mesh and particles to said substrate.

Preferably, the curable resin is partially cured after said mesh is embedded therein to securely bond the mesh layer to the base. This is followed by applying a second coating of the curable resin over the partially cured layer prior to embedding said grit particles therein. The resin then is substantially cured after which a third layer optionally including pigmentation is applied and cured to thoroughly anchor the grit particles. One or more layers of a surface finish such as paint may then be applied if desired.

BRIEF DESCRIPTION OF THE DRAWINGS

FIG. 6 is a perspective view of a portion of a ladder with the article of the present invention secured to each of the rungs;

FIG. 7 is a partial perspective view of the article of the present invention adapted to be used on the ladder shown in FIG. 6;

FIG. 8 is a frontal view of two rungs of a ladder with said article welded to said rungs;

FIG. 9 is a cross-sectional view taken along line 9—9 of FIG. 8.

DETAILED DESCRIPTION OF THE INVENTION

Figure 1:
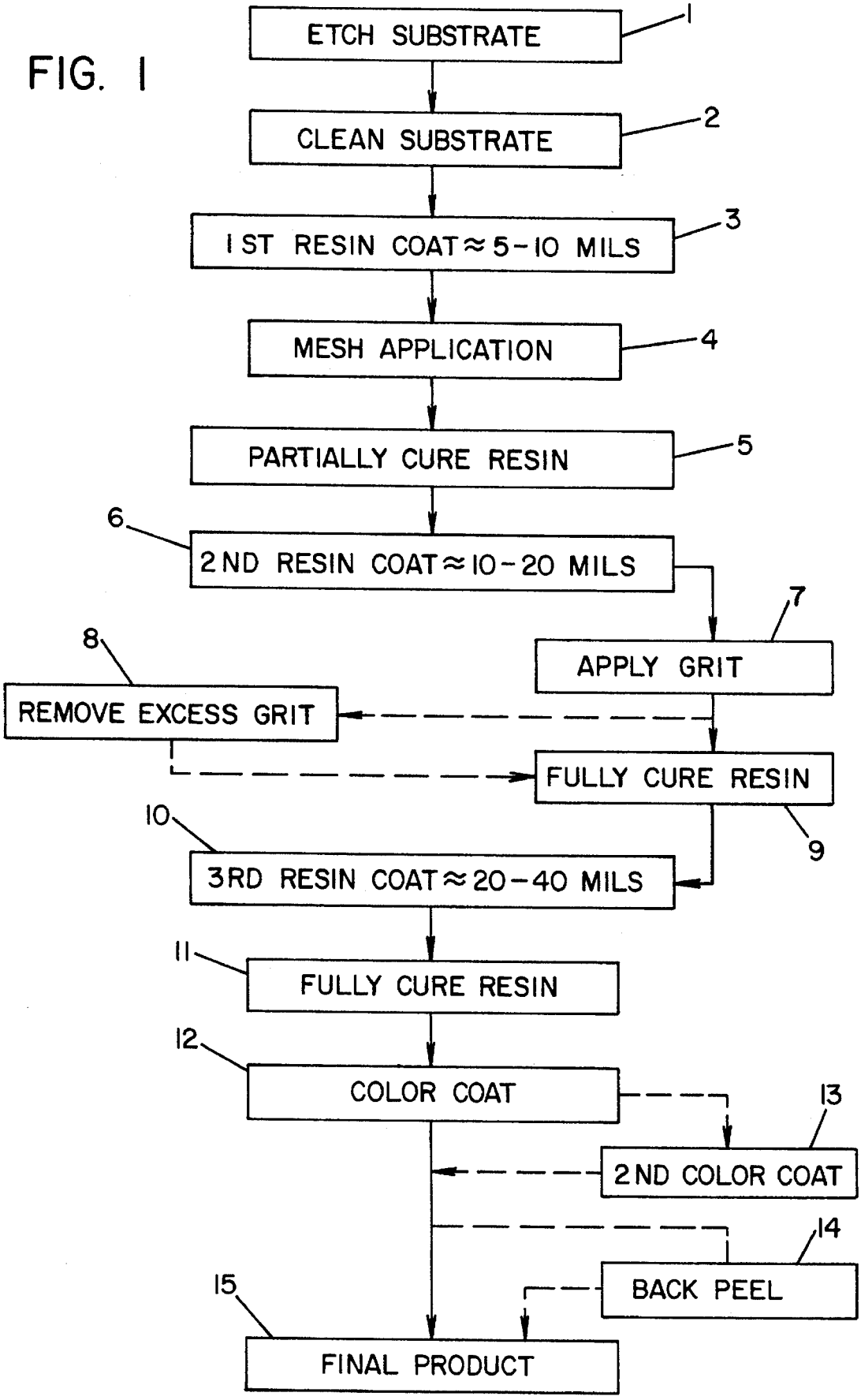
FIG. 1 a block diagram showing the steps of treating an article to give it a skid resistant surface.

Referring now in greater detail to the drawings, FIG. 1 shows a flow diagram for the process of treating a metallic substrate to give it a skid resistant surface. The surface can be made from a non-ferrous metal such as aluminum; however, the use of a ferrometallic substrate is preferred because of its high strength to thickness ratio and the ability to obtain better adhesion between the thermosetting resin and the ferrous substrate as contrasted with the adhesion obtainable with other metals. Stainless steel is a desirable ferrometallic substrate, particularly if the skid resistant surface is going to be used in environmentally hostile applications. The stainless steel is highly resistant to many chemicals, and in addition does not readily oxidize or rust. 304 Stainless Steel having a thickness of 20 gauge (36–38 mil) is found to be ideally suited for the purposes of the present invention. Although thicker substrates may be used, the hazards of tripping or stumbling over the surface increase as the thickness of the skid resistant surface increases. Accordingly, the thickness is preferably no more than about 20 gauge. If thinner substrates are used, the likelihood of the substrate buckling during processing, handling or installation greatly increases.

The etching of the metal surface is represented in block 1 of FIG. 1. This surface is preferably etched by mechanical means such as low pressure blasting with sand, glass beads, walnut shells or other appropriate media. The surfaces of the substrate that do not require etching may be covered with an adhesive backing which remains on the surface throughout the entire process of preparing the skid resistant surface to preserve the finish and appearance of the non-etched surfaces. Chemical or electrochemical etching are viable options but may concomitantly create waste treatment or disposal problems. The backing, if used, is typically removed prior to shipment or prior to use. However, there is no particular need to remove the backing except in those applications where the skid resistant surface needs to be adhesively bonded to the floor, stair treads or the like. If the substrate is to be shaped, etching of the metal can be done before or after forming.

The next step shown in block 2 comprises cleaning of the substrate to remove all traces of dirt, grease, and other deposits which remain on the etched surface after the etching process. The substrate is preferably cleaned using a biodegradable detergent or by using high pressure, e.g. 500 psi, water or a combination of both. However, as an alternative to these environmentally safe cleaning techniques, the surface of the substrate can be cleaned using a suitable solvent such as perchloroethylene, trichloroethylene, or acetone. However, the use of any of these organic solvents requires that steps be taken to minimize evaporation of the solvents, to equip workers with respirators where necessary, and to use appropriate and safe disposal methods for the waste solvents.

In step 3 a first layer of a thermosetting resin is applied to the clean, etched surface of the substrate. The preferred resin of this invention is one that is produced by the cationic polymerization of a monomeric material containing an oxirane or epoxy ring. These monomers are referred to as 1,2-1,3-, and 1,4 epoxides. These epoxides generally comprise mixtures containing one, two or more epoxy groups per molecule and have molecular weights typically ranging from about sixty to several thousand. Their polymerization is initiated by an acidic or basic promotor such as an amine catalyst. The thickness of the first resin layer is between about 5 and about 10 mils. The resin may be spread on the surface using a suitable doctor blade, spatula, paint roller, knife, trowel, brush or the like. There are many epoxides available on the market from several different suppliers. The epoxides that are preferred in the present invention are those that are two component room temperature curing epoxides that feature high shear and peel strength, and flexibility when fully cured. The cured resin should possess these properties over a wide temperature range while at the same time providing resistance to impact, thermal shock, vibration and stress fatigue cracking. Epoxy resin systems are known for their resistance to moisture, creep and corrosion when exposed to a wide range of chemicals, and their resistance to water, fuel, oils and many organic solvents even upon prolonged exposure. An adhesive resin containing no volatile organic solvents, is preferred from an environmental standpoint. A particularly effective epoxy resin for use in the first coating of the present invention is an elastomer modified epoxy resin containing a flow control agent such as silica and sold as Master Bond Polymer Adhesive Supreme 11 LV 2 by Master Bond, Inc. This resin when polymerized with an amine hardener gives outstanding bonding ability and peel strength between the mesh to be applied in the next step and the cleaned metal substrate, and has a degree of flexibility which is suitable for its intended use in adhering the mesh to the substrate.

Step No. 4 involves laying a reinforcing mesh over the uncured resin, making sure that the resin penetrates through the mesh interstices to securely anchor the mesh to the metal substrate. The viscosity of the resin should be low enough to permit penetration by the resin into the individual pores of the mesh material. Because of cost and availability, a particularly favorable form of mesh is a Style 6053-G cotton cloth having a 44×36 thread count and possessing no coatings or surface finishes to impede adhesion with the epoxy resin. This material can be purchased from Nutex Corporation. However, other fibers such as polyamides, polyesters, carbon, glass fibers and cotton/polyester blends may be used. Furthermore, metallic meshes such as screen wire can be used. When using a metallic mesh etching and/or cleaning of the mesh may be required to facilitate bonding between the epoxy resin and the mesh material.

When using a non-metallic mesh, particularly cotton, it is important for the ends of the mesh to be completely embedded in the epoxy resin to prevent delamination caused by hydrostatic pressure created by the wicking of moisture into the mesh through the ends of the fibers that are exposed to the atmosphere. The use of synthetic fibers such as polyester avoids this wicking problem.

In step No. 5, the resin is partially cured for example by exposure at room temperature for 6 hours or by heating to elevated temperatures such as 150° F. for 1 hour or 250° F. for 15 minutes to accelerate curing. Partial curing of the resin serves to prevent flow or spread of the resin, to commence the development of a strong bond between the resin and the metallic substrate, and to firmly establish the spatial relationship between the substrate and the mesh layer.

In step No. 6 a second coating of resin, preferably the same resin or resin compatible with that used in step No. 3 is applied over the first partially cured layer to a thickness of about 10 to about 20 mils. Although the same resin formulation can be used for both the first and second layers, the strength, peel strength and flexibility of the second layer need not be as high as for the first layer.

Step No. 7 involves the application of the grit to the surface of the second resin layer prior to curing. The type of grit to be selected is often dependent upon the end use application for the skid resistant surface. Silicon carbide, aluminum oxide and silica are three types of grit that can be used although in a preferred embodiment, silicon carbide is the grit of choice. Aluminum oxide is a more common grit and is less expensive. However, it suffers from the drawback that the sharp edges wear down at a faster rate than do the edges of the silicon carbide particles. Silica because of its ready availability and low cost can also be considered. Mixture of two or more of these compounds may also be used.

In an embodiment of the invention intended for heavy commercial use, the silicon carbide grit has a particle size distribution such that about 30–70% of the silicon carbide is 20 grit and about 70–30% of the silicon carbide is between 16 and 30 grit. More preferably, the ratio of the blend is about 50/50. If the product of this invention is to be sold for uses that are less demanding than the industrial market, particles having a smaller grit size may be used, thus producing a less abrasive surface.

The grit is applied to the surface of the uncured resin by any suitable means capable of applying a relatively uniform coating of grit over the resin. If means are not readily available for measuring the amount and distribution of the grit over the surface, optional step No. 8 consists of removing excess grit, for example by tilting the substrate and gently tapping to allow the excess grit to fall off.

After the grit is applied to the surface of the uncured resin, the entire resin system including the first and second layers are then fully cured in step 9, either at room temperature or at elevated temperatures. At room temperature, Master Bond Adhesive Supreme 11 develops 85% of its maximum bond strength within 24 to 48 hours. The bond strength increases continuously thereafter for about one week. The cure can be accelerated by heating the coated substrate at elevated temperatures, for example to 150° for 2 hours, to 250° F. for 30 minutes or to 300° F. for 10 minutes whereupon about 80% of the maximum bond strength is achieved. The bond continues to gain in strength for an additional three or four days before maximum strength is achieved. Excess grit particles can then be removed by brushing the surface with a stiff brush.

In step No. 10, a third layer of epoxy resin, approximately 20 to 40 mils in thickness is applied over the second resin layer and particles. Preferably, this resin is same as that used in the second layer, optionally colored with a compatible yellow or gray pigment. Following application of the third resin coat, it is then subjected to curing until a final cure is achieved in step No. 11. The third resin coating effectively anchors all of the particles of grit, but is sufficiently thin so as not to totally cover the particles nor diminish the effectiveness of the grit in providing a skid resistant surface.

The surface is preferably finished in step 11 by the application of one or more coats of paint or other protective finish applied to the top of the final cured resin. Depending upon the end use, and on the nature of the pigment (if any) contained in the third layer of resin, the coat or coats can be highly visible yellow, a luminescent coating, a coating providing protection from ultraviolet degradation of the epoxy resin, a coating providing a high durability surface for cleaning or for added chemical resistance, or wear, etc. One coating that is compatible with the epoxy resin system used in this invention is a polysilicone enamel such as P-1-8172 marketed by Keeler and Long. This coating contains no solvents or other ingredients that are environmentally harmful.

In step No. 13, an optional second protective or colored coating may be applied and in step No. 14, the adhesive backing may be peeled from the substrate to produce a final product 15.

Figure 2:
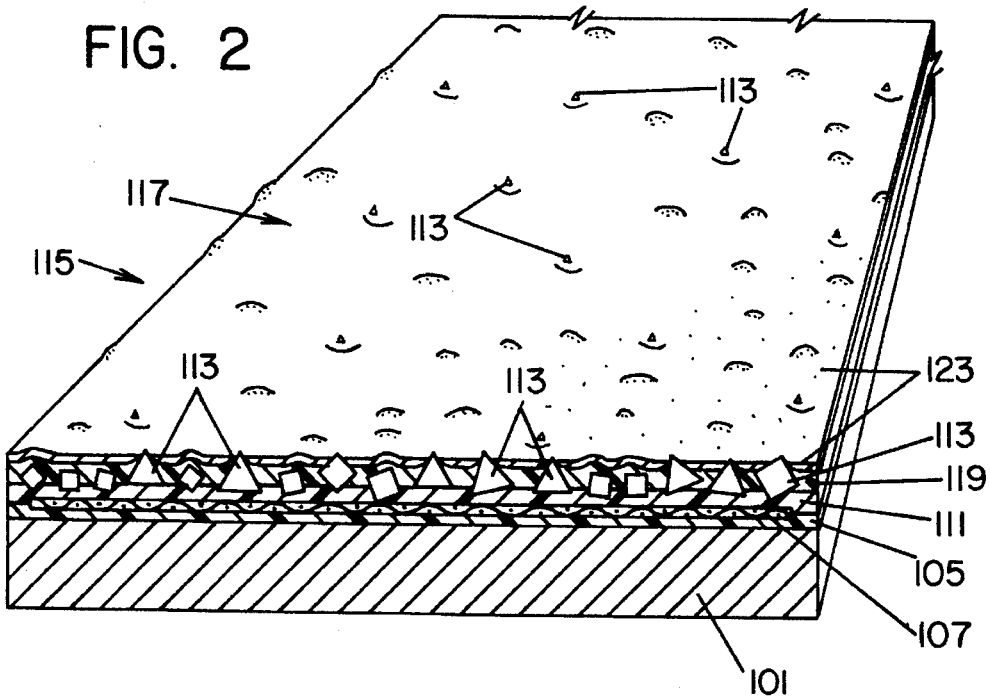
FIG. 2 is an enlarged perspective cross-sectional view of the article prepared by the sequence of steps shown in FIG. 1.

Turning now to FIG. 2, a cross-sectional perspective view of the product 115 of this invention is shown. As previously mentioned, the base metal substrate 101 preferably is composed of a corrosion resistant metal such as 304 stainless steel. A satisfactory thickness for the metal is between 16 gauge and 24 gauge, preferably 20 gauge (36–38 mils). Overlying the metal substrate is a mesh 107 embedded in a first layer 105 of thermosetting resin. Above the mesh are the grit particles 113 embedded in a thermosetting layer 111. The third resin layer 119 securely anchors the individual grit particles to the mesh reinforced substrate. Nevertheless, the relative thinness of the resin layer does not impede the ability of the sharp edges of the grit to provide a highly durable skid resistant coating. Although 3 discrete layers of resin are shown in FIG. 2, the interfaces between these layers are likely to be blurred or nonexistent after final curing of the resins. The total thickness of the resin in the finished product is between about 35 and about 70 mils. The thicknesses of the first, second and third resin layers typically are in the approximate ratios of 1:2:4. The color or protective layer 123 on top of the third layer of resin 119 serves one or more of the functions as previously indicated. The final skid resistant surface 117 is highly resistant to abrasion even under severe operating conditions.

Figure 3:
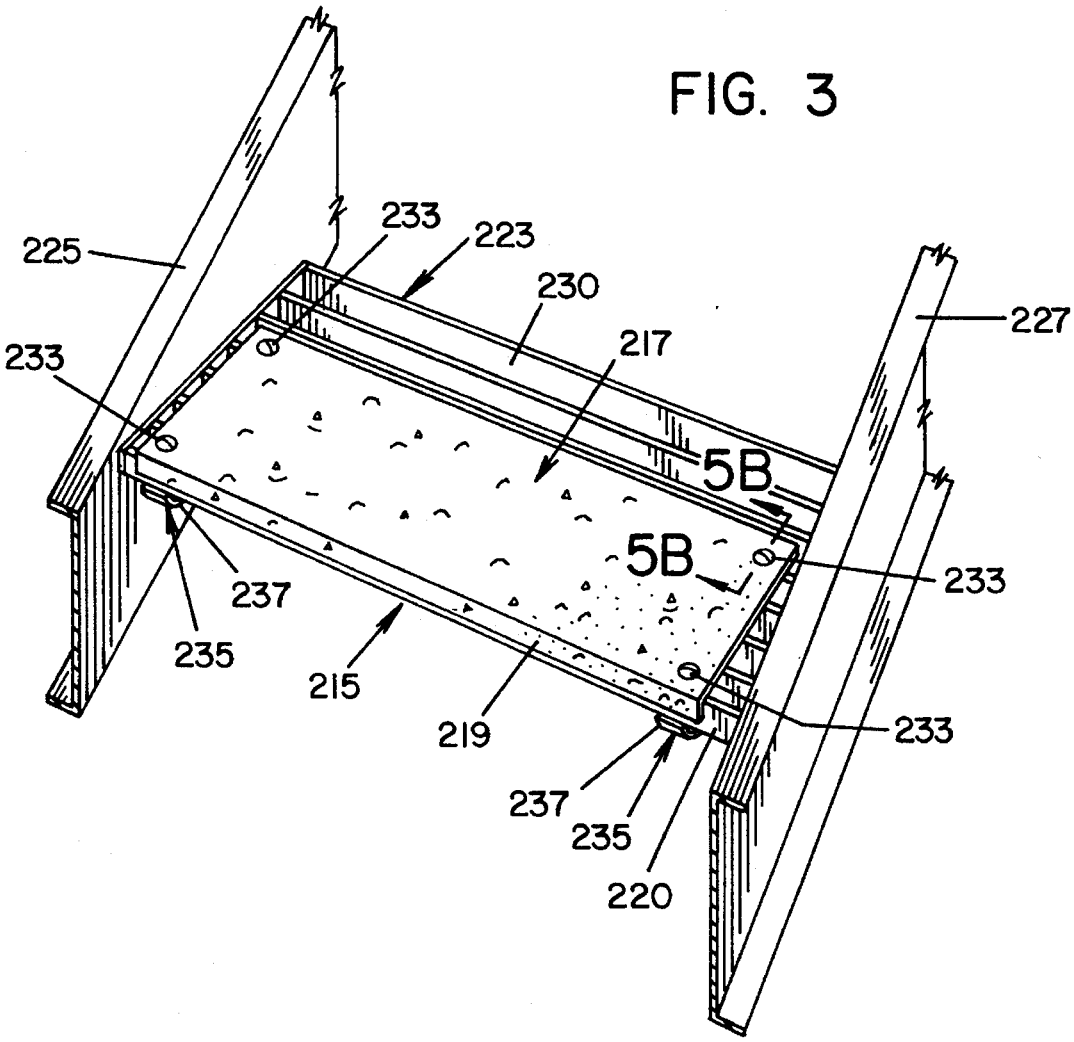
FIG. 3 s a perspective view, partially in cross-section, showing a skid resistant panel secured to a metal stair grating.
Figure 4:
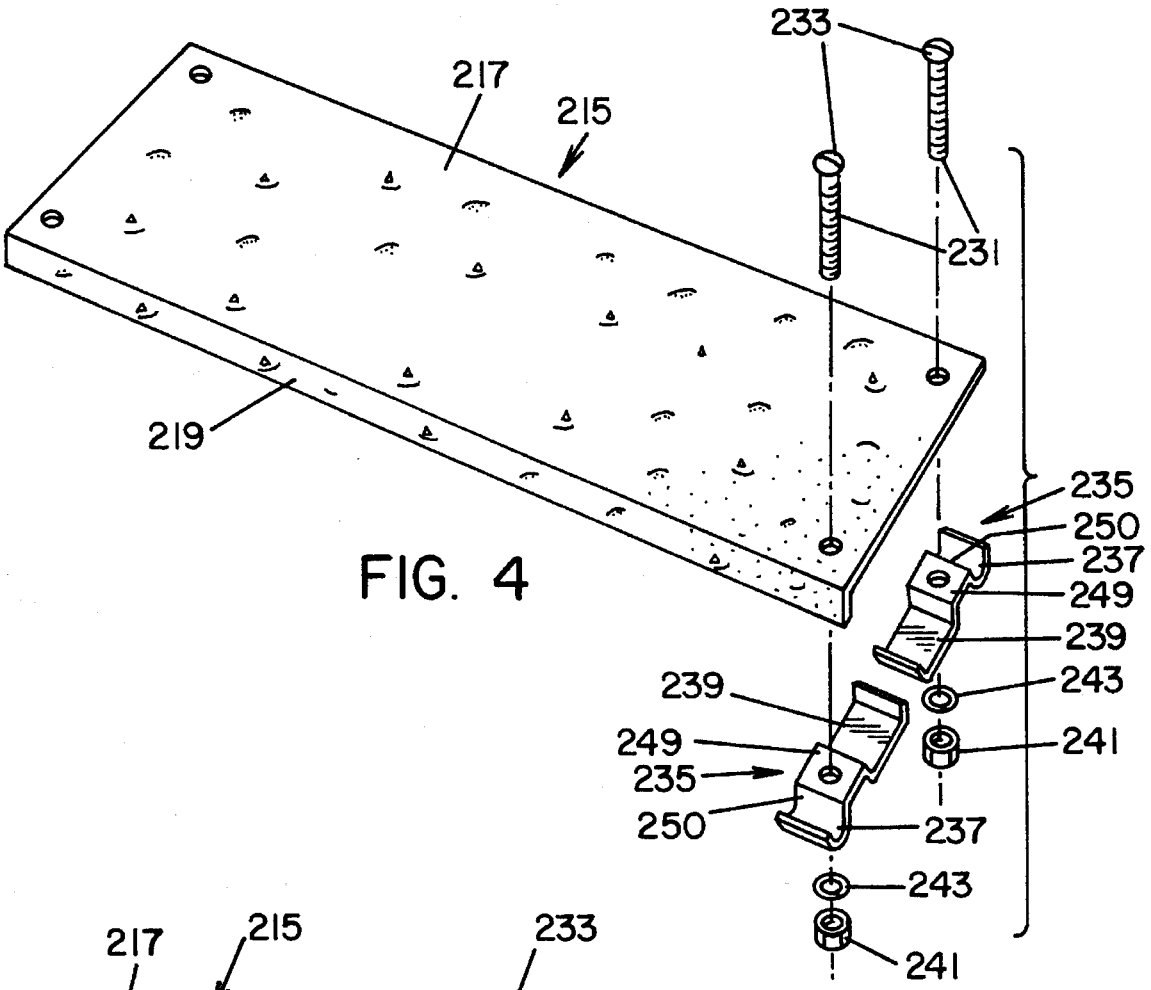
FIG. 4 is an exploded view of the assembly shown in FIG. 3.
Figure 5A:
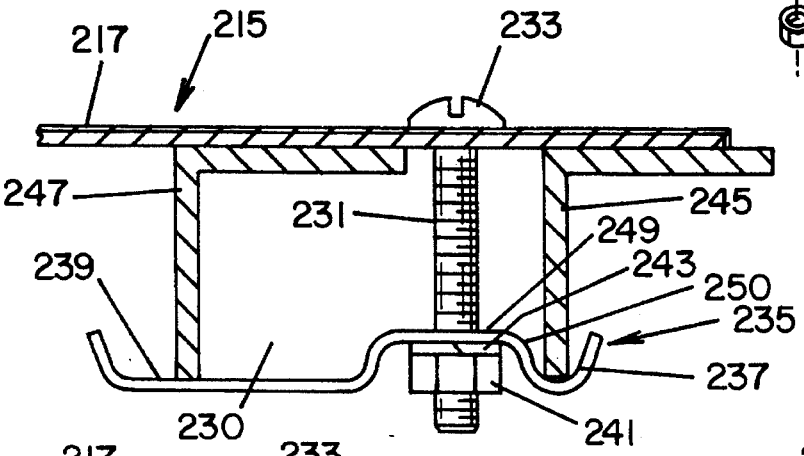
FIG. 5A shows another embodiment in cross-section of a stair grating similar to that of FIG. 3.
Figure 5B:
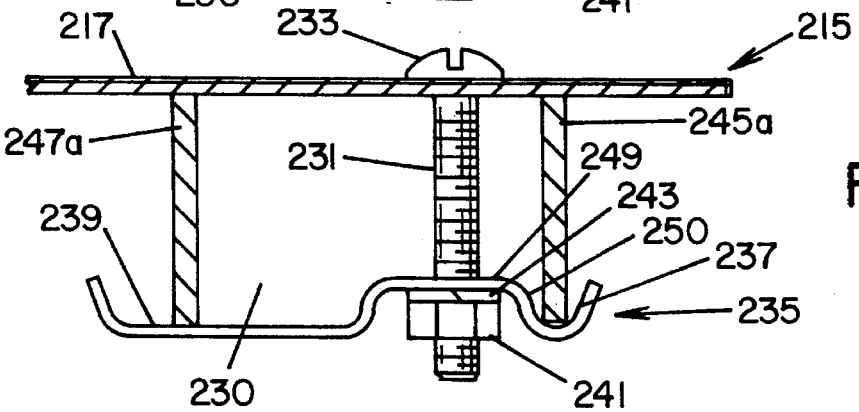
FIG. 5B shows an enlarged cross-section of the grating taken along lines 5—5 of FIG. 3.

The article of the present invention is designed to improve safety by preventing slipping on landings, walkways, catwalks, work stations, platforms, ramps, etc. FIG. 3 shows the application of the article to stairs made of metal grating. The shaped skid resistant article 215 consists of a tread cover 217, and a lip 219 covering the leading edge 220 of the stair. The stair consist of a plurality of grates 223 spaced from one another and connected to side channels 225, 227. The shaped skid resistant surface is held in place by fasteners comprising retainers such as saddle clips secured by nuts and bolts, as shown more clearly in FIGS. 4,5A and 5B. A unique saddle clip 235 is used with a nut 241, bolt 231, and lock washer 243. FIG. 5A shows the skid resistant article 215 secured in place over grating consisting of individual vertical, spaced L shaped angle bars 245, 247 spaced apart from another forming spaces 230. The saddle clip 235 consists of a positioning groove 237 adapted to engage one bar 245, a spacing slot 239 adapted to accommodate the second bar 247 and a plateau 249 joining the slot 239 and the groove 237 extending into the space 230 between bars 245 and 247. The plateau and groove form a shoulder 250 which serves to position the clip with respect to the grate 245. The clip is designed to accommodate a variety of spacings between adjacent grate bars 245 and 247 without the necessity of changing hardware. The bolt 231 preferably has a rounded slotted bolt head 233 with a low profile so as to minimize the hazard of a person tripping over the bolt head. Obviously the fasteners are mounted as close to the lateral sides of the skid resistant article as possible so as to minimize this hazard. Instead of having the entire head of the bolt projecting above the skid resistant surface, means can be employed to recess the head. For example, a circular portion of the polymeric surface around each bolt hole can be removed to permit the bolt head to be at least partially countersunk. Another option is to preform the ferrometallic substrate with recesses or dimples so that the top of the bolt heads are flush or slightly below said surface. As yet another option, a square hole can be formed in each of the recesses or dimples to receive the square neck of a carriage bolt, thereby facilitating the assembly of the article to the grate. FIG. 5*b* shows the shaped skid resistant article 215 secured by the fastener to vertical bars 245*a*, 247*a* in the same manner as that shown in FIG. 5A.

FIGS. 6–9 show the details of another embodiment of the invention comprising a channel shaped cover, prepared according to the teachings of the present invention, adapted to provide a skid resistant surface on ladder rungs of different cross-sectional shapes. FIG. 7 shows the shaped article 315 of the present invention including the ferrometallic channel-shaped substrate 316, and the skid resistant surface 317 applied thereover. The skid resistant layer does not extend clear to the end of the substrate but instead terminates short thereof to leave the end portion 303 of metal substrate uncoated. Suitable means such as masking are used during the manufacture of the article to prevent the portion 303 from being coated with the epoxy resin.

The perspective view of FIG. 6 shows a portion of a ladder 305 comprising rungs 307 anchored inside supports 309 and 311. Covering each rung is one of the skid resistant articles of the present invention. The frontal view of the ladder is shown in FIG. 8 wherein the skid resistant rung covers are welded to the rungs by spot welds 323 also shown in more detail in FIG. 9. The rung covers can be designed and shaped to cover rungs having a variety of cross-sectional shapes, such as round, semi-circular, square, etc. In the event that the rung cover is made of a material which cannot be readily welded to the rungs, other means such as adhesives or mechanical fasteners may be used to adhere or attach the covers to the rungs. This is particularly applicable to the rungs of wooden ladders. However, in applications where it is contemplated that the rung cover will be welded to the rung, the exposed end portions 303 of the covers, permit spot or tack welding without the components of the skid resistant surface interfering with the weld, or the heat of the weld causing thermal degradation or other damage to the polymeric layer.

Various modifications and alterations of this invention will become apparent to those skilled in the art without departing from the scope and spirit thereof. For instance, the metal substrate may be treated, coated or otherwise prepared by means other than, or in addition to etching to receive and bond to the polymeric resin. Deposition of other metals including alloys from acid or alkaline eletroplating or electroless baths, or conversion coatings of phosphates or trivalent chomates are a few of the options that can be used.

It should be understood that this invention is not to be unduly limited to the embodiments described herein but instead are limited by a reasonable interpretation of the claims.

Having thus described the invention it is claimed:

1. A shaped article having a skid resistant surface, said article adapted to be secured to stairs, ladder rungs, planar surfaces and the like, said article comprising a. a shaped ferrometallic base composed of stainless steel having a thickness between about 16 and about 24 gauge;

b. a flexible mesh layer covering at least that portion of said ferrometallic base wherein skid resistance is desired, said flexible mesh being adhered to said ferrometallic base by a cured thermosetting resin; and c. particles of grit embedded in said cured thermosetting resin on top of the flexible mesh layer.

2. The article according to claim 1, wherein said cured thermosetting resin is a polyepoxide resin.

3. The article according to claim 2, wherein said flexible mesh layer is composed of cotton cloth.

4. The article according to claim 3, wherein said cotton cloth is entirely embedded in the polyepoxide resin.

5. The article of claim 4, wherein the polyepoxide resin embedding the mesh has high sheer and peel strength and is modified with an elastomer for increased flexibility.

6. The article according to claim 2, wherein said particles of grit are selected from the group consisting of silicon carbide, aluminum oxide, silica, and mixtures thereof.

7. The article according to claim 6, wherein the particles of grit comprise silicon carbide present in a mixture of between about 30 and about 70% of particles having a size of about 20 grit and between about 70 and about 30% of particles of grit having a particle size distribution of between about 16 and about 30 grit.

8. The article according to claim 6, further including a top coating of paint.

9. The article according to claim 2, wherein the total thickness of the polyepoxide resin on the base is between about 35 mils and about 70 mils.

10. In combination with a stair tread having a leading edge, a shaped article comprising a planar tread surface to cover at least a portion of said tread to provide a skid resistant surface therefor, a lip at right angles to said planar surface to cover the leading edge of said tread, and means for securing said shaped article to said stair tread, said article comprising:

a. a shaped metallic base comprising stainless steel having a thickness between about 16 and about 24 gauge;

b. a flexible mesh layer composed of cotton cloth, said layer covering at least that portion of said metallic base wherein skid resistance is desired, said flexible cotton cloth being entirely embedded in a polyepoxide resin, and being adhered to said metallic base by said resin, said resin having high sheer and peel strength, and being modified with an elastomer for increased flexibility; and c. particles of grit embedded in said polyepoxide resin on top of said flexible mesh layer.

11. In the combination according to claim 10, wherein the embedded grit particles are selected from the group consisting of silicon carbide, aluminum oxide, silica, and mixtures thereof.

12. In combination with a shaped article having a ferrometallic base with a skid resistant surface thereon and bonded thereto by a polyepoxide resin and a grating comprising a plurality of parallel spaced apart grate bars, at least two fasteners securing said shaped article to said grating, each fastener comprising a clip containing a groove for positioning said clip with respect to a first grate bar, a plateau joining said groove to form a shoulder to prevent relative movement between said grate bar and said clip, said plateau extending into a spacing between said first bar and an adjacent grate bar, and containing a hole to receive a threaded fastener extending through the skid resistant surface and through the grating, and a spacing slot to receive the adjacent grate bar, said spacing slot being wider than said first groove to accommodate differences in spacing between adjacent bars of said grating.

13. The combination of claim 12, wherein each of said fasteners comprises a nut and bolt assembly.

14. The combination according to claim 13, wherein said shaped article comprises:

a. a stainless steel base having a thickness between about 16 gauge and about 24 gauge;

b. a flexible mesh layer covering at least that portion of said base wherein skid resistance is desired, said flexible mesh being adhered to said base by a polyepoxide resin; and c. particles of grit embedded in said polyepoxide resin on top of the flexible mesh layer.

15. The combination according to claim 14 wherein the total thickness of the polyepoxide layers on the base is between about 35 mils and about 70 mils.

16. A shaped article adapted for use on top of a metal grating of the type comprising a plurality of parallel metal bars spaced from one another to form spacings, said article including fasteners useful for securing said article to the grating during assembly, said article having a skid resistant surface and comprising a shaped base of stainless steel having a thickness of between about 16 and about 24 gauge, a flexible mesh layer covering at least that portion of the base wherein skid resistance is desired, said mesh being adhered to the base by a polyepoxide resin having a total thickness between about 35 and about 70 mils, and particles of grit embedded in said resin on top of the flexible mesh layer, each fastener comprising a clip and a threaded fastening means, said clip including a positioning groove, a plateau joining said groove and forming a shoulder therewith, said plateau having a hole to receive said fastening means, and a spacing slot having a width greater than the width of said groove, the shaped article likewise having a hole therethrough to receive the fastening means, the clip adapted to be placed on the underside of a metal grating with one metal bar of the grate adapted to engage the groove and the next adjacent bar adapted to engage the spacing slot, the plateau adapted to extend into the spacing between bars with the fastening means serving to secure the shaped article to the grate.

17. The article according to claim 16 wherein the particles of grit are selected from the group consisting of silicon carbide, aluminum oxide, silica, and mixtures thereof.

18. The article according to claim 16, wherein said threaded fastening means comprises a nut and bolt assembly.

* * * * *